United States Patent [19]

Kubota

[11] 4,152,067

[45] May 1, 1979

[54] BLADE CLEANING DEVICE

[75] Inventor: Atsushi Kubota, Tokyo, Japan

[73] Assignee: Canon Kabushiki Kaisha, Tokyo, Japan

[21] Appl. No.: 861,493

[22] Filed: Dec. 16, 1977

[30] Foreign Application Priority Data

Dec. 28, 1976 [JP] Japan ..... 51-159312

[51] Int. Cl.[2] ..... G03G 21/00

[52] U.S. Cl. ..... 355/15; 15/256.51; 118/652

[58] Field of Search ..... 355/15; 134/6; 118/652; 15/256.51

[56] References Cited

U.S. PATENT DOCUMENTS

| | | | |
|---|---|---|---|
| 3,918,807 | 11/1975 | Hwa | 355/15 |
| 3,936,183 | 2/1976 | Sadamatsu | 355/15 |
| 3,951,542 | 4/1976 | Ito et al. | 355/15 |

*Primary Examiner*—R. L. Moses

*Attorney, Agent, or Firm*—Fitzpatrick, Cella, Harper & Scinto

[57] ABSTRACT

In a blade cleaning device having an elastic blade adapted to bear against the surface of a member to be cleaned, thereby cleaning said surface, support means is provided for supporting the elastic blade so as to enable the same to bear against the surface of the member to be cleaned, and vibration suppressing means is provided for suppressing the vibration created in the elastic blade.

34 Claims, 5 Drawing Figures

BLADE CLEANING DEVICE

BACKGROUND OF THE INVENTION

1. Field of the Invention

This invention relates to a blade cleaning device usable in the electrophotographic copying apparatus or the like, and more particularly to such a blade cleaning device which is prevented from vibrating during a cleaning operation.

2. Description of the Prior Art

As the cleaning device for cleaning the photosensitive medium or the like in electrophotographic apparatuses, the fur brush cleaning device or the web cleaning device has heretofore been proposed and put into use.

A typical example of the former device is disclosed in U.S. Pat. No. 2,832,977, and a typical example of the latter device is disclosed in U.S. Pat. No. 3,186,838. Both of these devices can accomplish practical cleaning. Nevertheless, the former device suffered from scattering of removed toner and necessitated the provision of an absorption collector equipped with a dust collecting filter such as a vacuum cleaner for absorbing scattered toner and moreover, the toner so collected was trapped in the dust collecting filter within the absorption collector and could not practically be reused. The latter device required means for transporting a web to be urged against the photosensitive medium, and was apt to impart damages to the surface of the photosensitive medium, which in turn led to frequent needs to replace the photosensitive medium. Furthermore, the web surface became abraded during cleaning and the removed toner was trapped between the fibers of the web and could not be reused in practice.

To overcome the various problems peculiar to these types of cleaning devices, a novel type of cleaning device known as the blade cleaning device has been proposed and put into practice. The technique pertaining to such blade cleaning device is disclosed in U.S. Pat. No. 3,438,706 issued to Hiroshi Tanaka et al., and its improved techniques are disclosed in U.S. Pat. No. 3,859,691 issued to Hajime Katayama et al., U.S. Pat. No. 3,927,936 issued to Shigehiro Komori et al. and U.S. Pat. No. 3,917,398 issued to Toru Takahashi et al.

In the blade type cleaning device, a blade is urged against the surface of a member to be cleaned, practically such as a photosensitive medium, to effect cleaning, but stick slip vibration tends to occur at the area of contact between the blade and the cleaned member and such stick slip vibration has sometimes caused vibration of particularly great amplitude understandable as an oscillation phenomenon to be induced in the blade cleaning portion comprising the blade and its holder shaft. Such vibration has produced a sound which has become unpleasant noise to the user.

Moreover, such vibration could be transmitted to other units of the apparatus to adversely affect the quality of copy image, including the formation of a blurred image, and further to cause loosening of the set screws for various units.

The aforementioned stick slip vibration is considered attributable to the friction characteristic in the area of contact between the blade and the photosensitive medium which results from the quality of the material and roughness of the surface of the photosensitive medium and the quality of the material and roughness of the blade, and various methods for preventing occurrence of such phenomenon in the cleaning device have been studied heretofore. However, only U.S. Pat. No. 3,552,850 discloses a method using an antifriction material which may be regarded as an effective method and as far as the inventor knows, there has been disclosed no technique directed to the solution of the stick slip vibration in an electrophotographic apparatus.

Moreover, the stick slip vibration is closely related to the friction characteristic in the area of contact between the drum surface and the blade, as already noted, and various factors are considered to be so complexly correlated with such friction characteristic that it is difficult to eliminate the stick slip vibration only by the use of the aforementioned antifriction material, for example. The use of such antifriction material affects the cleaning performance and may further affect the surface characteristic of the photosensitive medium to produce blur in the formed image, thus making it very difficult to obtain a good result.

SUMMARY OF THE INVENTION

It is an object of the present invention to provide an improved blade cleaning device.

It is another object of the present invention to provide a blade cleaning device which is prevented from vibrating in the cleaning blade portion.

It is still another object of the present invention to provide a blade cleaning device which is prevented from vibrating in the cleaning portion, and is prevented from producing objectionable noise.

Generally described, the blade cleaning device of the present invention comprises an elastic blade, holder means for holding the elastic blade and vibration suppressing means for damping the vibration created in the elastic blade.

Particularly, the cleaning device as constructed for use in an electrophotographic apparatus using a drum-type photosensitive medium or an endless belt type photosensitive medium movable in an endless form is very preferable as an embodiment of the present invention.

Other objects and features of the present invention will be fully understood by those skilled in the art when the following detailed description is read in conjunction with the accompanying drawings.

DESCRIPTION OF THE PREFERRED EMBODIMENTS

Figure 1:
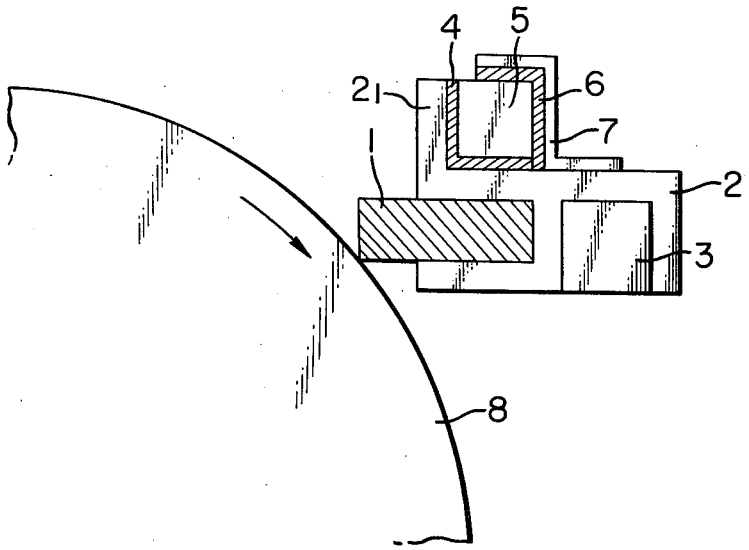
FIG. 1 is a side elevation of a specific embodiment of the device according to the present invention.
Figure 2:
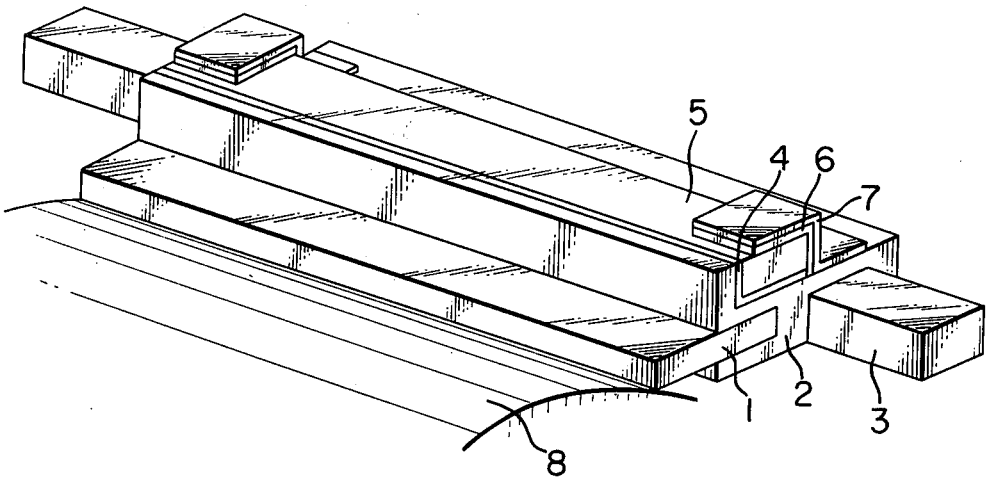
FIG. 2 is a perspective view of the FIG. 1 device.

FIG. 1 is a side elevation of the device according to an embodiment of the present invention, and FIG. 2 is a perspective view thereof. These show the device as applied to a photosensitive drum. An elastic blade 1 is embraced by a holder 2 which is secured to a shaft 3, supported by the body of an apparatus, so that the blade is engageable and disengageable with the surface of a member to be cleaned such as a photosensitive drum 8 or the like. The holder 2 has one end formed with a projected portion $2_1$ which is adhesively lined with a damper 4 formed of a soft material such as rubber or the like, and a vibration suppressing member 5 is placed on the damper. A damper 6 formed of a material similar to that of the damper 4 is attached to the opposite ends of the vibration suppressing member 5, and a support member 7 secured to the holder 2 is placed on the damper 6 to softly support and position the damper 6 on the holder 2. Thus, the vibration suppressing member 5 is vibratory with respect to the holder.

The elastic blade 1 has its edge portion urged against the surface of the drum 8 to frictionally clean that surface with the rotation of the drum. In that case, the blade edge portion may sometimes cause stick slip vibration on the drum surface due to the friction characteristic between the drum surface and the edge portion. Such vibration may be transmitted to the holder, the shaft, etc. to induce an oscillation phenomenon in the blade-holder system (the main vibration system). Such oscillation may be transmitted through the damper 4 to the vibration suppressing member 5 as well, thus resulting in vibration of the vibration suppressing member 5 on the holder 2. Such vibration of the vibration suppressing member serves as a vibration suppressor acting on the blade-holder system which has begun oscillating, thereby damping the oscillation phenomenon of the blade-holder system. Such damping effect is momentarily exhibited to stop the oscillation of the blade-holder system on the spot. Simultaneously therewith, the vibration suppressing member 5 becomes stationary on the holder 2. The vibration suppressing member for damping the oscillation in this manner must have a sufficient weight to exhibit its vibration suppressing effect.

Of course, the shape of the vibration suppressing member 5 may be optimally selected in accordance with the structure and oscillatory state of the blade holder system. The vibration suppressing member may assume the rod-like shape as shown, or other rod-like shape having non-uniform cross-section so as to distribute the weight at the portions of great oscillation amplitude. On the other hand, the damper 4 interposed between the holder and the support member for restraining the vibration suppressing member leads to the effect of preventing occurrence of impact sound during vibration suppression while maintaining the vibration suppressing action of the vibration suppressing member. Also, the support member for enabling the vibration suppressing member to be installed on the holder or the elastic blade must be designed so as not to interfere with the vibration suppressing action of the vibration suppressing member, but it will be apparent that this support member is not restricted to the shown form as long as it restrains the vibration suppressing member without interfering with the vibration suppressing action thereof.

The vibration suppressing member may be located on the blade or the holder or any other suitable position, but it is essential that the vibration suppressing member be located at a position to which the vibration is transmitted from the blade-holder system (the main vibration system) and which can transmit the vibration suppressing action of the vibration suppressing member to the main vibration system.

The mechanism of the vibration phenomenon will now be described to make the present invention understood more easily.

This vibration phenomenon in the blade-holder system (the main vibration system) is peculiar to a system comprising distinct materials differing in physical properties such as elastic modulus, damping coefficient, density, etc. and having irregular axial rigidity, and is extremely difficult to analyze. Much more complicated and difficult to analyze accurately is the phenomenon of suppressing the vibration created by the blade-holder system of the present invention. However, it has been ascertained that this vibration phenomenon is an oscillation phenomenon created by the relationship between the frequency of stick slip vibration and the natural frequency of the main vibration system such as the blade, holder, shaft, etc. When the device of the present invention as described above can extinguish the oscillation phenomenon is considered attributable to the fact that the oscillation resulting from the stick slip vibration created in the elastic blade is transmitted to the vibration suppressing member through the damper 4, whereby the vibration suppressing member begins vibrating and such vibration assumes an opposite phase relationship with the vibration of the main vibration system so that a force acts in the direction to negate the vibration of the main vibration system, thus exhibiting a vibration suppressing effect.

If the phenomenon is so interpreted, the importance of the aforementioned design in which the vibration suppressing action of the vibration suppressing member is not interfered with will become fully convincing. In other words, if the vibration suppressing member was fixed on the blade, holder, etc. in such a manner that the vibration suppressing member vibrates in phase with the vibration of the main vibration system, the vibration suppressing action of the vibration suppressing member would apparently be interfered with and the vibration suppressing effect thereof could not be expected.

Since the vibration suppressing member accomplishes a good vibration suppressing action by being designed to follow the vibration of the main vibration system in the opposite phase with the latter, the vibration suppressing member must be capable of effecting vibration of good follow-up characteristic in the sense that it vibrates substantially in the opposite phase with the main vibration system.

When viewed in terms of the weight of the vibration suppressing member, too light a weight of this member would cause great bounce of the vibration suppressing member on the main vibration system which in turn would lead to aggravation of the follow-up characteristic and difficulties of vibration in the opposite phase as well as greatly reduced vibration suppressing effect. Accordingly, the vibration suppressing member must have a predetermined or greater weight with respect to the main vibration system.

A better result will be obtained if the vibration suppressing member is disposed adjacent to the maximum amplitude portion of the oscillation of the main vibration system or the weight distribution of the vibration suppressing member is localized adjacent to said portion, in order that the vibration suppressing effect of the vibration suppressing member may be efficiently exhibited. Thus, the vibration suppressing action takes place in the maximum amplitude portion of the vibration of the main vibration system and this leads to quick and efficient establishment of the vibration suppressing effect.

Figure 3:
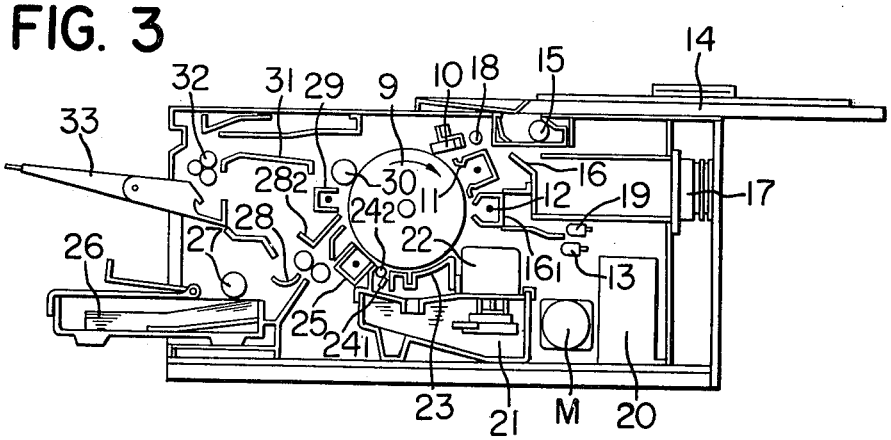
FIG. 3 is a side view of an electrophotographic apparatus incorporating therein the cleaning device of the present invention.

FIG. 3 shows a side view of an electrophotographic apparatus in which the above-described device of the present invention is incorporated. This electrophotographic apparatus comprises a drum-shaped photosensitive medium disposed centrally thereof, cleaning means disposed above the photosensitive medium, electrostatic latent image formation means disposed to the right of the photosensitive medium, developing means disposed below the photosensitive medium, and image transfer means disposed to the left of the photosensitive medium, and is further provided with paper feed means and image fixing means. The photosensitive medium comprises a photoconductive layer and a transparent insulating layer overlaid thereon. The electrostatic image formation means includes a primary charger 11, an AC discharger 12 and a whole surface illuminating lamp 13. An original resting on an original carriage 14 may be illuminated by an original illuminating lamp 15 and the reflected image light of the original is directed via a mirror 16 and an in-mirror lens 17 and projected on the photosensitive medium through a slit 16 on the AC discharger 16, whereby an electrostatic latent image corresponding to the original may be formed on the photosensitive medium. Details of the construction of such photosensitive medium and its electrostatic latent image formation process are disclosed, for example, in U.S. Pat. No. 3,666,363. The apparatus further includes a pre-illumination lamp 18 and a blank illumination lamp 19. The lamp 18 is provided to maintain uniformity of the copy density during continuous copying and the lamp 19 is for illuminating blank portions of the photosensitive medium unexposed to the image light from the original to thereby maintain such blank portions at a low potential. Designated by 20 is a high-voltage transformer unit which forms a high voltage source for the aforementioned various chargers. M is a main motor for supplying a drive to the photosensitive drum, the original carriage, etc.

Developing means for developing the electrostatic latent image formed on the photosensitive medium is designed such that developing liquid filling a liquid tank 21 is pumped up into a developing dish 23 by a pump 22 so as to be used for the development. Designated by 24 is a squeeze roller for squeezing excess liquid, and $24_1$ a cleaning blade for cleaning the surface of the squeeze roller.

After development, the surface of the photosensitive medium is subjected to the post-charge by a post-charger 25 and rendered suitable for image transfer to be effected.

Transfer mediums contained in a paper supply cassette 26 are fed one after another by a paper feed roller 27 through paper guide plates $28_1$ and $28_2$ to an image transfer station.

Having arrived at the image transfer station, the transfer medium is subjected to image transfer discharge from the back thereof by an image transfer corona discharger 29, whereby the developed image on the transfer medium is transferred from the surface of the photosensitive medium to the transfer medium.

Thereafter, the transfer medium is separated from the surface of the photosensitive medium and transported to the fixing means by the action of a separating roller 30 having a separating belt stretched thereon. The fixing means has a heated heater plate 31 which promotes the fixation of the transferred image on the transfer medium as the latter is moved along the heater plate. Having passed through the fixing means, the transfer medium is discharged by a set of discharge rollers 32 onto a paper discharge tray 33. In the meantime, the surface of the photosensitive medium after the image transfer is well cleaned by the aforementioned cleaning device 10, thus becoming ready for reuse.

The cleaning device is disposed at that side of the photosensitive drum whereat the rotational direction of the drum turns downwardly, and as shown, the blade of the cleaning device is supported in such a manner that the blade surface forms an acute angle with the cleaned surface of the photosensitive medium, thereby ensuring a good cleaning effect even during long-time use. In addition, the vibration created in the blade portion is sufficiently suppressed to thereby avoid non-uniform abrasion or damage which would otherwise be imparted to the end edge of the blade or the surface of the photosensitive medium by the vibration of the blade.

In the electrophotographic apparatus of the described construction, the cleaning device performs its function without vibrating and this eliminates any risk of accident which would otherwise occur to various parts of the apparatus, even during long-time use.

Moreover, the elimination of any abnormal vibration which would otherwise be created in the blade portion leads to the elimination of the fear that the developing liquid collected near the engagement between the photosensitive medium and the blade is scattered around by the vibration, and thus the elimination of the possibility of the apparatus interior being contaminated by the removed developing liquid. Accordingly, this electrophotographic apparatus is quiet and free of vibration during its operation, thus eliminating the possibility of giving noise to the environment even if no sound insulation is provided in the apparatus. Further, the apparatus interior is free from the risk of being contaminated by the scattered developing liquid which would otherwise result from abnormal vibration of the cleaning portion, and readily permits the maintenance work to be carried out.

An example of the present invention will be shown below to make the invention more readily understood.

EXAMPLE

With the copying apparatus of FIG. 3, the cleaning effect and vibrating condition of the specific cleaning device (FIGS. 1 and 2) of the present invention was confirmed.

The cleaning blade of the cleaning device had a thickness of 8 mm, a width of 15 mm and a length equal to the width of the photosensitive drum of the copying apparatus. The damper 4 used was formed of rubber with a thickness of 0.5 mm and a width of 14 mm. The vibration suppressing member 5 was provided by a square iron bar having a weight of 120 g, a side dimension of 7 mm and a length of 300 mm.

For comparison, cleaning was first carried out with the vibration suppressing member 5 removed, and then cleaning was carried out with the vibration control member 5 attached.

An acceleration detecting pickup was installed at a point A occupying substantially the middle axially of the blade holder 7 to detect the amplitude of vibration, and the result was recorded by a synchroscope.

Figure 4:
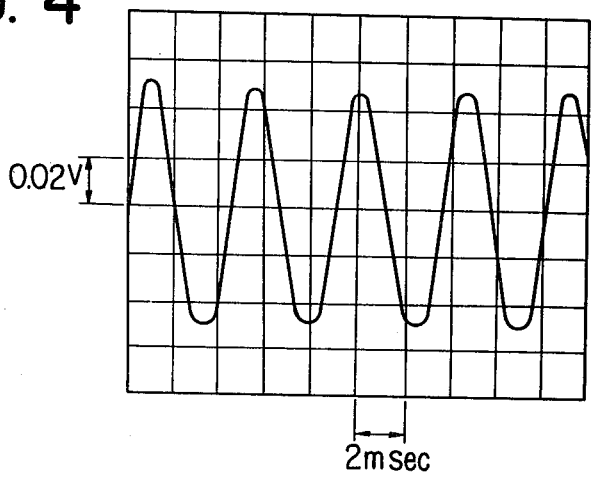
FIG. 4 is a graph of the vibration induced when cleaning is carried out with the vibration suppressing member removed from the cleaning device of the present invention.

The cleaning carried out with the vibration suppressing member 5 removed was good in cleaning effect but created vibration which presented a state of oscillation having a great amplitude. Such vibrating condition is illustrated in FIG. 4.

Figure 5:
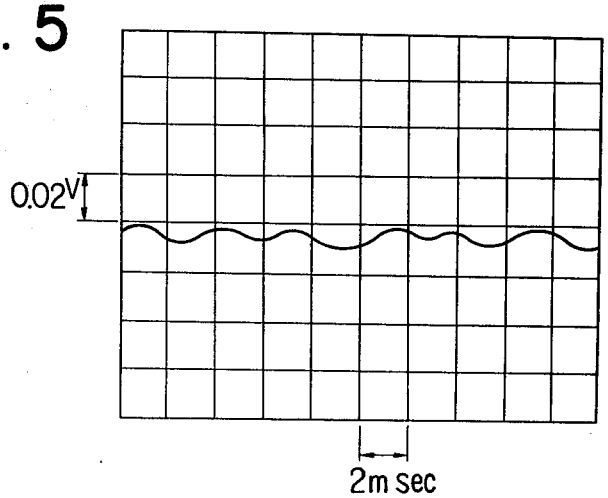
FIG. 5 is a graph of the vibration induced when cleaning is carried out by the device of the present invention.

Next, the cleaning carried out with the vibration suppressing member 5 attached was good in cleaning effect and the vibration created therewith did not present a state of oscillation having a great amplitude. This is illustrated in FIG. 5, which very clearly shows the effect of the present invention, as compared with FIG. 4.

As will be appreciated, the device of the present invention exhibits a stable sound insulation effect by a very simple construction and is thus highly effective for long-time use. Moreover, the oscillation phenomenon in a wide range of vibration which may take place in the blade cleaning device can be sufficiently prevented. This is turn alleviates the restrictions imposed upon the drum speed, the blade pressure and the materials which would otherwise be required to prevent the stick slip vibration of the blade edge portion, and advantageously widens the tolerances of these factors and the range of use.

I claim:

1. A blade cleaning device comprising an elastic blade adapted to bear against the surface of a member to be cleaned, thereby cleaning said surface, support means for supporting said elastic blade so as to enable the same to bear against the surface of said member to be cleaned, and vibration suppressing means for suppressing the vibration created in said elastic blade, said suppressing means being mounted in a position with respect to said elastic blade and support means wherein blade vibrations are transmitted to said suppressing means.

2. A blade cleaning device according to claim 1, wherein said vibration suppressing means has a vibration suppressing member for suppressing the vibration.

3. A blade cleaning device according to claim 2, wherein said vibration suppressing means has holder means for holding said vibration suppressing member.

4. A blade cleaning device according to claim 3, wherein said holder means holds said vibration suppressing member vibratorily.

5. A blade cleaning device according to claim 3, wherein said holder means has a restraining member secured to said support means.

6. A blade cleaning device according to claim 5, wherein said holder means has a damper member interposed between said vibration suppressing member and said restraining member.

7. A blade cleaning device according to claim 4, wherein said holder means holds said vibration suppressing member so as to enable the same to vibrate in the opposite phase with respect to the vibration created in said elastic blade.

8. A blade cleaning device according to claim 1, wherein said member to be cleaned is a photosensitive medium having a photoconductive layer.

9. A blade cleaning device according to claim 1, wherein said member to be cleaned is a drum-type photosensitive medium having a photoconductive layer.

10. A blade cleaning device comprising an elastic blade adapted to bear against the surface of a member to be cleaned, thereby cleaning said surface, support means for supporting said elastic blade so as to enable the same to bear against the surface of said member to be cleaned in such a manner that one surface of said elastic blade forms an acute angle with said surface of said member to be cleaned, and vibration suppression means for suppressing the vibration created in said elastic blade, said suppressing means being mounted in a position with respect to said elastic blade and support means wherein blade vibrations are transmitted to said suppressing means.

11. A blade cleaning device according to claim 10, wherein said vibration suppressing means has a vibration suppressing member for suppressing the vibration.

12. A blade cleaning device according to claim 11, wherein said vibration suppressing means has holder means for holding said vibration suppressing member.

13. A blade cleaning device according to claim 12, wherein said holder means holds said vibration suppressing member vibratorily.

14. A blade cleaning device according to claim 12, wherein said holder means has a restraining member secured to said support means.

15. A blade cleaning device according to claim 14, wherein said holder means has a damper member interposed between said vibration suppressing member and said restraining member.

16. A blade cleaning device according to claim 13, wherein said holder means holds said vibration suppressing member so as to enable the same to vibrate in the opposite phase with respect to the vibration created in said elastic blade.

17. A blade cleaning device according to claim 10, wherein said member to be cleaned is a photosensitive medium having a photoconductive layer.

18. A blade cleaning device according to claim 10, wherein said member to be cleaned is a drum-type photosensitive medium having a photoconductive layer.

19. A blade cleaning device comprising an elastic blade adapted to bear against the surface of an endlessly movable member to be cleaned, thereby cleaning said surface, support means for supporing said elastic blade so as to enable the same to bear against the surface of said member to be cleaned in such a manner that one surface of said elastic blade forms an acute angle with said surface of said member to be cleaned, and vibration suppressing means for suppressing the vibration created in said elastic blade, said suppressing means being mounted in a position with respect to said elastic blade and support means wherein blade vibrations are transmitted to said suppressing means.

20. A blade cleaning device according to claim 19, wherein said vibration suppressing means has a vibration suppressing member for suppressing the vibration.

21. A blade cleaning device according to claim 20, wherein said vibration suppressing means has holder means for holding said vibration suppressing member.

22. A blade cleaning device according to claim 21, wherein said holder means holds said vibration suppressing member vibratorily.

23. A blade cleaning device according to claim 21, wherein said holder means has a restraining member secured to said support means.

24. A blade cleaning device according to claim 23, wherein said holder means has a damper member interposed between said vibration suppressing member and said restraining member.

25. A blade cleaning device according to claim 22, wherein said holder means holds said vibration suppressing member so as to enable the same to vibrate in the opposite phase with respect to the vibration created in said elastic blade.

26. A blade cleaning device according to claim 19, wherein said member to be cleaned is a photosensitive medium having a photoconductive layer.

27. A blade cleaning device according to claim 19, wherein said member to be cleaned is a drum-type photosensitive medium having a photoconductive layer.

28. A blade cleaning device comprising an elastic blade adapted to bear against the surface of a drum-type photosensitive medium to remove any residual developer from said surface, support means for supporting said elastic blade so as to enable the same to bear against the surface of said photosensitive medium, and vibration suppressing means for suppressing the vibration created in said elastic blade, said suppressing means being mounted in a position with respect to said elastic blade and support means wherein blade vibrations are transmitted to said suppressing means.

29. A blade cleaning device according to claim 28, wherein said vibration suppressing means has a vibration suppressing member for suppressing the vibration.

30. A blade cleaning device according to claim 29, wherein said vibration suppressing means has holder means for holding said vibration suppressing member.

31. A blade cleaning device according to claim 30, wherein said holder means holds said vibration suppressing member vibratorily.

32. A blade cleaning device according to claim 30, wherein said holder means has a restraining member secured to said support means.

33. A blade cleaning device according to claim 32, wherein said holder means has a damper member interposed between said vibration suppressing member and said restraining member.

34. A blade cleaning device according to claim 31, wherein said holder means holds said vibration suppressing member so as to enable the same to vibrate in the opposite phase with respect to the vibration created in said elastic blade.

* * * * *